US008439284B2

(12) United States Patent
Ha et al.

(10) Patent No.: US 8,439,284 B2
(45) Date of Patent: May 14, 2013

(54) SEPARATION SYSTEM FOR WASTE FOUNDRY SAND BINDER USING ULTRASONIC WAVES

(75) Inventors: Soo Hyun Ha, Seoul (KR); Whee Moon Choi, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 328 days.

(21) Appl. No.: 12/939,746

(22) Filed: Nov. 4, 2010

(65) Prior Publication Data

US 2012/0000997 A1 Jan. 5, 2012

(30) Foreign Application Priority Data

Jun. 30, 2010 (KR) ..... 10-2010-0062569

(51) Int. Cl.
*B02C 19/00* (2006.01)
*B02C 23/00* (2006.01)

(52) U.S. Cl.
USPC ..... 241/65; 241/101.2; 241/DIG. 10

(58) Field of Classification Search ..... 241/65, 241/101.2, 301, DIG. 10
See application file for complete search history.

(56) References Cited

U.S. PATENT DOCUMENTS 5,271,450 A * 12/1993 Bailey ..... 164/5
5,279,741 A * 1/1994 Schott ..... 210/634
5,515,907 A * 5/1996 Boenisch ..... 164/456

FOREIGN PATENT DOCUMENTS

| | | | |
|---|---|---|---|
| JP | 63-023790 | A | 2/1988 |
| JP | 2000-051996 | A | 2/2000 |
| JP | 2002-361005 | A | 12/2002 |
| JP | 2008-126300 | A | 6/2008 |
| KR | 10-0402412 | | 11/2001 |
| KR | 10-0334367 | B1 | 4/2002 |
| KR | 10-0442191 | | 7/2004 |

* cited by examiner

*Primary Examiner* — Faye Francis
(74) *Attorney, Agent, or Firm* — Edwards Wildman Palmer LLP; Peter F. Corless

(57) ABSTRACT

The present invention provides a separation system for a waste foundry sand binder using ultrasonic waves, which can minimize the number of surface treatment processes by inducing interface separation between a foundry sand and a binder, and which further optimizes the working process and reduces the recycling cost of waste foundry sand.

12 Claims, 6 Drawing Sheets

SEPARATION SYSTEM FOR WASTE FOUNDRY SAND BINDER USING ULTRASONIC WAVES

CROSS-REFERENCE TO RELATED APPLICATION

This application claims under 35 U.S.C. §119(a) the benefit of Korean Patent Application No. 10-2010-0062569 filed Jun. 30, 2010, the entire contents of which are incorporated herein by reference.

BACKGROUND (a) Technical Field

The present disclosure relates to a separation system for a waste foundry sand binder. More particularly, it relates to a system for separating a binder attached to waste foundry sand using ultrasonic waves.

(b) Background Art

A foundry sand containing silica as a main component, and having excellent fire resistance, is widely used as a material for a casting mold used in a foundry. In general, a binder containing various additives and water are added to the foundry sand, which preferably has a grain size of 20 to 70 mesh. The mixture is then placed in a mold having a pattern on the surface, and it is hardened by various methods, to thereby form a casting mold.

When a cast product is produced using the thus formed casting mold, the binder is carbonized on the surface of the foundry sand (e.g. by the heat of molten metal). Thereafter, the foundry sand becomes waste foundry sand.

The waste foundry sand, however, has reduced fire resistance, air permeability, and moldability. Therefore, various techniques for recycling the waste foundry sand have been developed.

The conventional methods for recycling the waste foundry sand are generally divided into two categories.

According to a first conventional recycling method, the waste foundry sand is physically collected, sorted and separated for different uses, such as flux for copper smelting, as a subsidiary material for brick production, as a material for embankment, as a subsidiary material for cement production, etc.

According to a second conventional recycling method, a high-temperature treatment (at 700° C. or higher) is performed to oxidize (or burn) the binder attached to the surface of the waste foundry sand, and the binder on the surface is struck with a hard object (impact surface treatment) or dropped to a grinding stone (grinding surface treatment) to separate the binder from the surface of the waste foundry sand.

However, in this second method, a large amount of fuel is required to burn the binder and, after burning, greenhouse gases such as carbon dioxide are released into the atmosphere. Moreover, the impact and grinding surface treatments that are used cause crushing of the waste foundry sand and excessive atomization, thereby reducing the recovery rate. Therefore, it takes a long time to remove the binder from the surface of the waste foundry sand, there is a decrease in recovery, and significant operating expenses are incurred using this method.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention provides a separation system for a waste foundry sand binder. In preferred embodiments, the waste foundry sand binder is removed using ultrasonic waves. Using the present methods, the number of surface treatment processes can be minimized by inducing interface separation between a foundry sand and a binder, and further, the working process is optimized and the recycling cost of waste foundry sand is reduced. This is in contrast to conventional expensive heat treatment and surface treatment processes.

In one aspect, the present invention provides a separation system for a waste foundry sand binder using ultrasonic waves. In a preferred embodiment, the system includes an ultrasonic surface treatment apparatus, which comprises a grinding rod rotatably mounted therein to mix waste foundry sand and water, and an ultrasonic device mounted therein to apply ultrasonic waves to the mixture of waste foundry sand and water. The present separation system is configured and arranged so as to generate air bubbles on the critical surface between the waste foundry sand and a binder and in gap(s) of the binder, thereby causing separation of the binder from the waste foundry sand. On ore more cracks in the binder are then formed by impact energy generated when the air bubbles collapse. The system can further include a dehumidifying dryer, which dehumidifies the mixture of waste foundry sand and water discharged from the ultrasonic surface treatment apparatus, and which dries the waste foundry sand. For example, in one exemplary embodiment, the waste foundry sand is dried by supplying air heated by an electric heater or the like, which is mounted in an air blower which delivers the heated air. In preferred embodiments, the system further includes a binder grinding apparatus to remove the binder remaining on the dried waste foundry sand by grinding. The grinding apparatus is not particularly limited, and in an exemplary embodiment it comprises a grinding rod rotatably mounted therein to remove the binder.

In a preferred embodiment, the ultrasonic surface treatment apparatus includes: a surface treatment chamber, which can be provided with one or more projections and recesses formed in an alternating arrangement on the inner circumferential surface; a grinding rod mounted inside the surface treatment chamber to rotate the mixture of waste foundry sand and water stored in the surface treatment chamber; and one or more ultrasonic devices mounted inside the surface treatment chamber to apply ultrasonic waves to the mixture of waste foundry sand and water.

In a preferred embodiment, a plurality of ultrasonic devices are mounted inside the surface treatment chamber, and the ultrasonic devices include: a first ultrasonic device which generates ultrasonic waves in a position before a projection of the surface treatment chamber to form bubble nuclei on the critical surface between the waste foundry sand and the binder and in the gap(s) of the binder; and a second ultrasonic device which generates ultrasonic waves in a position adjacent to the projection of the surface treatment chamber to cause the bubble nuclei to grow and collapse.

In a preferred embodiment, the grinding rod may include one or more projection and one or more recess which extend in the longitudinal direction and which are formed in an alternating arrangement about the circumferential direction of the rod.

In another preferred embodiment, the grinding rod may have a tapered shape in which the diameter decreases from the top to the bottom of the rod.

In another preferred embodiment, the separation system of the present invention further includes a hopper and a crusher, such that a waste casting mold is fed into the hopper and is crushed into the waste foundry sand by the crusher. The after the mold has been crushed into the waste foundry sand, it is then supplied to the ultrasonic surface treatment apparatus.

In a further preferred embodiment, the separation system of the present invention further includes a sieve, particularly a vibrating sieve, which sieves the waste foundry sand with a standard grain size, preferably using vibration, before the waste foundry sand is supplied to the ultrasonic surface treatment apparatus.

In another further preferred embodiment, the separation system of the present invention further includes a centrifugal dust collector which can include, for example, a bag filter at the top to collect the binders separated from the waste foundry sand due to a difference in specific gravity between the waste foundry sand and the binder.

In still another further preferred embodiment, the separation system of the present invention further includes a sieving device which sieves the recycled foundry sands discharged from the binder grinding apparatus.

In yet another further preferred embodiment, the binder grinding apparatus includes: a surface treatment chamber including one or more projections and one or more recesses formed on the inner circumferential surface; and a grinding rod rotatably mounted inside the surface treatment chamber to rotate the waste foundry sand stored in the surface treatment chamber.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
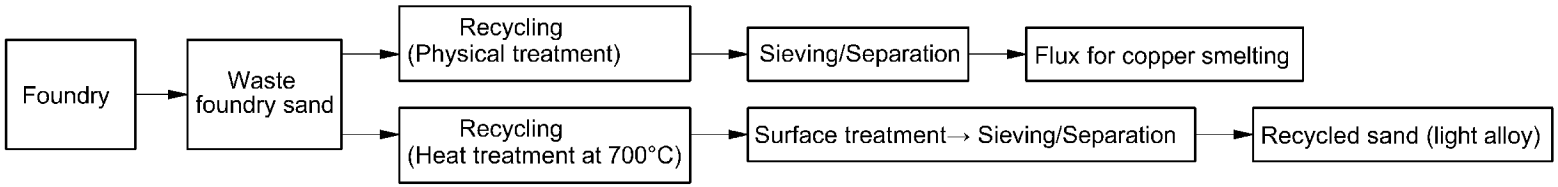
FIG. 1 is a block diagram showing a conventional method for recycling waste foundry sand.

Reference numerals set forth in the Drawings includes reference to the following elements as further discussed below:

| | |
|---|---|
| 10: | waste foundry sand |
| 11: | carbonizing binder |
| 12: | fixing binder |
| 13: | binder |
| 20: | hopper |
| 21: | crusher |
| 22: | vacuum pump |
| 23: | vibrating sieve |
| 24: | hopper |
| 25: | surface treatment chamber |
| 25a: | projection |
| 25b: | recess |
| 26: | grinding rod |
| 26a: | rotating shaft |
| 26b: | grinding rod body |
| 27: | ultrasonic device |
| 27a: | first ultrasonic device |
| 27b: | second ultrasonic device |
| 28: | inlet |
| 29: | water pipe |
| 30: | outlet |
| 31: | dehumidifying dryer |
| 32: | dehumidifying chamber |
| 33: | electric heater |
| 34: | air blower |
| 35: | centrifugal dust collector |
| 36: | bag filter |
| 37: | binder grinding apparatus |
| 38: | grinding rod |
| 39: | sieving device |
| 40: | ultrasonic surface treatment apparatus |

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Figure 2:
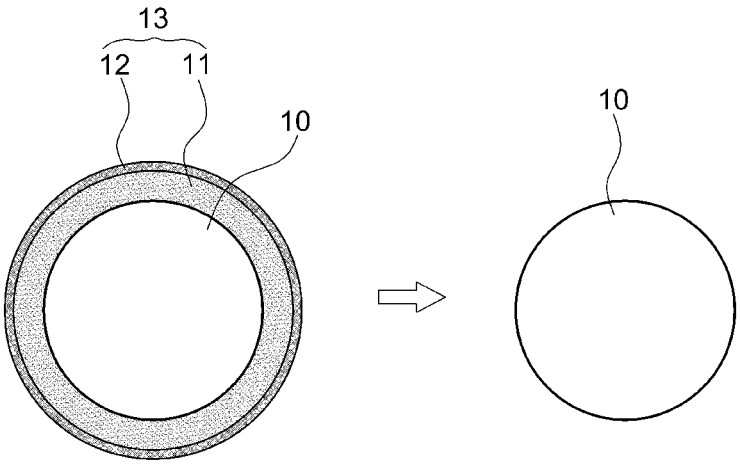
FIG. 2 is a schematic diagram showing that a binder is removed from waste foundry sand.

The present invention provides a system for separating a binder from waste foundry sand, for example as depicted in the schematic diagram of FIG. 2 which shows removal of binder 13 from waste foundry sand 10. In preferred embodiments, the binder is separated from the waste foundry sand using ultrasonic waves. The present methods can minimize the number of surface treatment processes required for binder removal by inducing interface separation between a waste foundry sand 10 and a binder 13. The present methods can further optimize the working process and reduce the recycling cost of waste foundry sand 10 by integrating multi-step processes.

When the foundry sand is used to manufacture a cast product, the foundry sand becomes carbonized by a high-temperature process which is carried out at about 1,200° C. or higher during manufacture of the cast product. As a result, a carbonizing binder 11 and a fixing binder 12 are cured and bond to the surface of the waste foundry sand 10, as depicted in FIG. 2.

The present invention provides a separation system and method for the waste foundry sand binder that removes the carbonizing binder 11 and the fixing binder 12 from the surface of the waste foundry sand 10.

Figure 3:
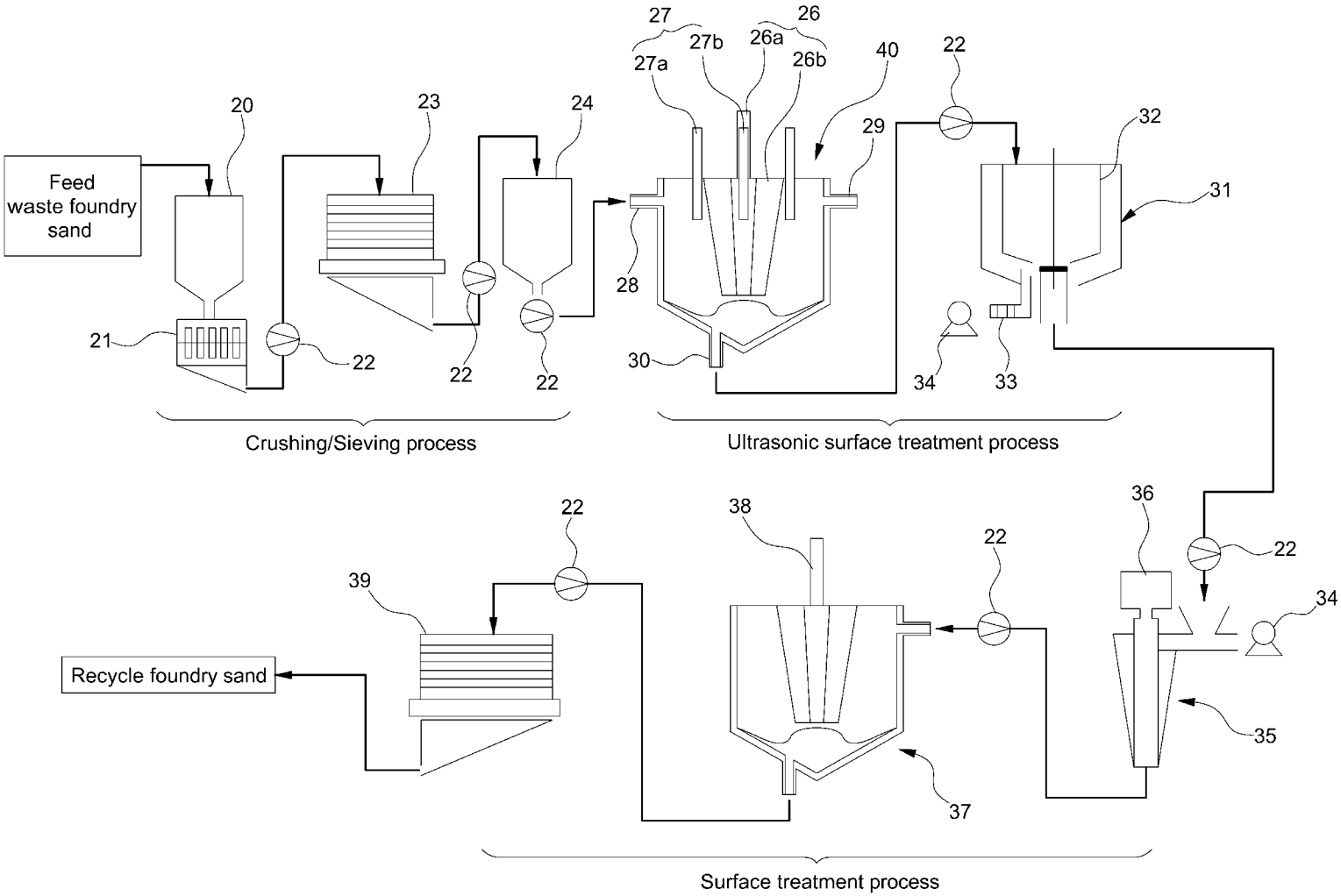
FIG. 3 is a schematic diagram showing a separation system for a waste foundry sand binder in accordance with an embodiment of the present invention.

In accordance with an embodiment of the invention, as depicted in FIG. 3, the separation system for the waste foundry sand binder includes three processes which will be referred to as a crushing/sieving process, an ultrasonic surface treatment process, and a surface treatment process.

As shown in FIG. 3, a casting mold carbonized during casting, generally by the heat of molten metal, is fed into a hopper 20 and is crushed into waste foundry sand 10 by a crusher 21. As shown, the crusher 21 can be installed at the bottom of the hopper 20. Of course, other arrangements of the hopper 20 and the crusher 21 could also be provided.

The waste foundry sand 10 crushed by the crusher 21 is then transferred to a sieving step to provide waste foundry sand having a desired particle size. For example, as shown in FIG. 3, a vibrating sieve 23 is provided, and the waste foundry sand from the crusher 21 can be delivered to the sieve 23 by a vacuum pump 22. The vibrating sieve 23 includes a mesh with the desired mesh size, for example a size of 58 to 64 mesh is particularly preferred in many applications, such that the waste foundry sand 10 can be sieved by vibration, to obtain waste foundry sand 10 having a desired grain size, such as 58 to 64 mesh.

The waste foundry sand 10 sieved by the vibrating sieve 23 can then proceed to the next process: the ultrasonic surface treatment process. As shown in FIG. 3, in some embodiments the waste foundry sand 10 from the vibrating sieve is first transferred to a hopper 24, for example by a vacuum pump 22 or the like, and is delivered therefrom to the ultrasonic surface treatment process.

In particular, according to the embodiment set out in FIG. 3, waste foundry sand 10 stored in the hopper 24 is transferred to the ultrasonic surface treatment apparatus 40, for example by use of a vacuum pump 22 or the like.

Figure 4:
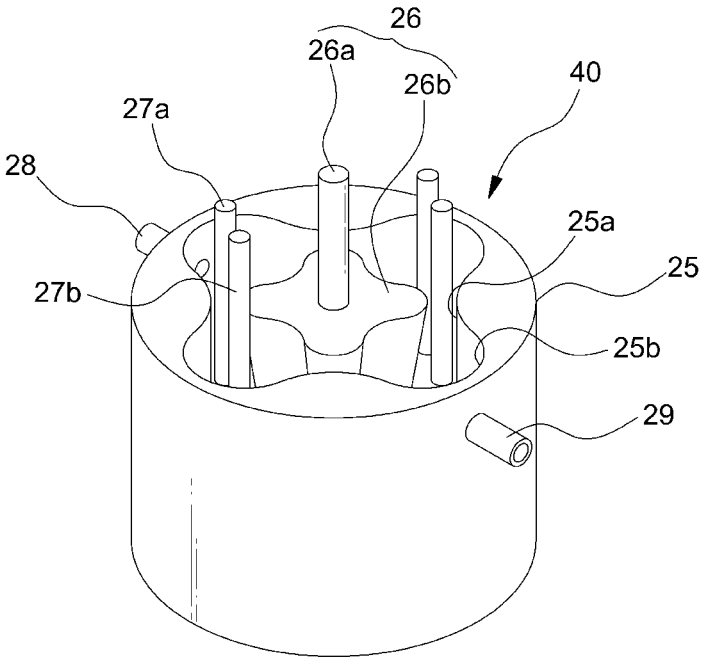
FIG. 4 is a perspective view showing an ultrasonic surface treatment apparatus of FIG. 3.

FIG. 4 shows in greater detail one embodiment of the ultrasonic surface treatment apparatus which can be used in accordance with the present invention.

In particular, as shown in the embodiment of FIG. 4, the ultrasonic surface treatment apparatus 40 includes a surface treatment chamber 25 having an inlet 28 at the top of one side and an outlet 30 at the bottom, a grinding rod 26 rotatably mounted in the center of the surface treatment chamber 25, and a plurality of ultrasonic devices 27 mounted inside the surface treatment chamber 25. It is noted that while the inlet 28 and outlet 30 are described as being located at the top and bottom of the chamber 25 respectively, the arrangement is not thus limited, but rather, any arrangement of inlet 28 and outlet 30 may suitably be provided. Further, while the grinding rod 26 is shown mounted in the center of the chamber and the ultrasonic devices 27 are depicted in a particular arrangement, it is also understood that the grinding rod 26 and ultrasonic devices 27 could also be provided in various other arrangements.

The inlet 28 of the surface treatment chamber 25 can be in connection with an outlet of the hopper 24, for example by a hose or the like, such that the waste foundry sand 10 stored in the hopper 24 can be fed into the ultrasonic surface treatment apparatus 40 through the inlet 28.

A solution inlet means is provided to deliver a solution (e.g. water) to the inside of the ultrasonic surface treatment apparatus 40. For example, in one embodiment as shown in one FIG. 4, a water pipe 29 is installed at the top of one side of the surface treatment chamber 25 such that a solution (water) is supplied to the inside of the ultrasonic surface treatment apparatus 40 through the water pipe 29. In some embodiments a solution (water) level regulator can further be provided so that when the solution reaches a predetermined level, the solution supply is automatically stopped by the solution (water) level regulator.

In certain preferred embodiments, the surface treatment chamber 25 has a cylindrical shape and includes a space for storing the solution and waste foundry sand 10.

In a preferred embodiment, for example, as shown in FIG. 4, the surface treatment chamber 25 includes projections **25*a* and recesses 25*b* disposed on the inner circumferential surface of the chamber 25 in an alternating pattern to provide a concave-convex shape on the inner circumferential surface, which increases the frictional force between the waste foundry sands 10 and/or between the waste foundry sand and the projections 25*a*** when a mixture of waste foundry sand and water flows along the concave-convex surface.

In a preferred embodiment, for example as shown in FIG. 4, the grinding rod 26 includes a grinding rod body **26*b* that is vertically disposed in the surface treatment chamber 25, and a rotating shaft 26*a* in the center of the grinding rod body 26*b*. The rotating shaft 26*a* can be in connection with a motor (not shown) to rotate the grinding rod body 26*b*** by the operation of the motor.

Figure 5:
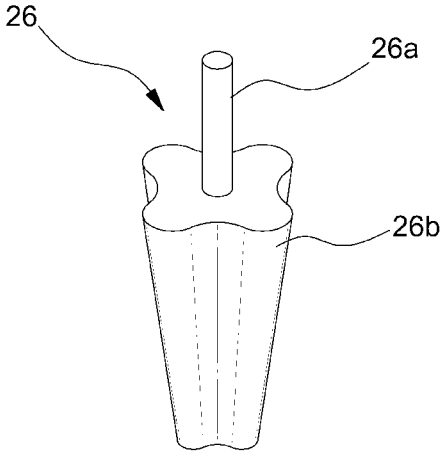
FIG. 5 is a perspective view showing a grinding rod of FIG. 4.

In a preferred embodiment, for example as shown in FIG. 5, the grinding rod body **26*b* includes one or more projections and recesses disposed longitudinally and arranged in an alternating pattern to thereby provide an outer concave-convex shape. When the grinding rod body 26*b* is used to stir and rotate the mixture of waste foundry sand and water stored in the surface treatment chamber 25, outer concave-convex shape formed by the projections and recesses further increases the frictional force between the waste foundry sands 10 and/or between the waste foundry sand and the projections 25*a* when the mixture of waste foundry sand and water flows along the concave-convex surface of the outside of the grinding rod 26. This increased frictional force is further in cooperation with the increased frictional force provided by the concave-convex surface of the surface treatment chamber 25** described above.

As shown in FIG. 5, in a preferred embodiment, the grinding rod body **26*b* has a conical shape, i.e., a tapered shape in which the diameter decreases from the top to the bottom of the grinding rod body 26*b*. As such, when a frictional force is generated between the waste foundry sands 10, the waste foundry sands 10 can be prevented from rising from the bottom of the surface treatment chamber 25 by an increase in density at the top of the surface treatment chamber 25, and thus the frictional force between the waste foundry sands 10 is increased. As a result, the binder that cracks by ultrasonic wave treatment is further separated from the waste foundry sand 10** by the frictional force.

Figure 9:
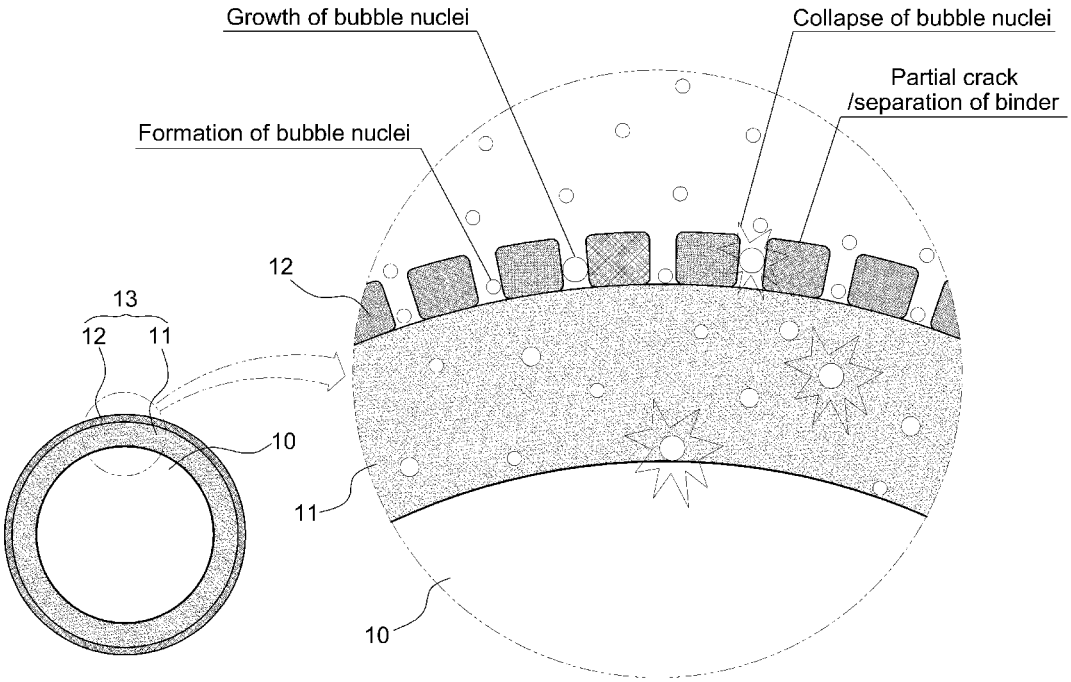
FIG. 9 is an enlarged view illustrating the formation, growth, and collapse of bubble nuclei by ultrasonic waves in accordance with the present invention.

In accordance with the present systems and methods, an ultrasonic device 27 applies ultrasonic waves to a mixture of waste foundry sand and water to form bubble nuclei, such that interface separation between the waste foundry sand 10 and the binder 13 is induced by a growth and collapse of the air bubbles when a unit density between the waste foundry sands 10 is increased or maximized, for example, as depicted in FIG. 9.

In an exemplary embodiment, the ultrasonic device 27 includes a first ultrasonic device 27*a* disposed adjacent to a recess 25*b* of the surface treatment chamber 25, and a second ultrasonic device 27*b* disposed adjacent to a projection 25*a* of the surface treatment chamber 25. In a preferred embodiment shown in FIG. 7, the first and second ultrasonic devices 27*a* and 27*b* are symmetrically disposed with respect to the grinding rod 26.

It is preferred that the first and second ultrasonic devices 27*a* and 27*b* have the same general configuration but generate ultrasonic waves of different frequencies. The ultrasonic devices 27*a*, 27*b* can be disposed in respective areas that are of different size, for example, in one embodiment, the first ultrasonic device 27*a* is disposed in an area larger than the second ultrasonic device 27*b*.

It is believed that advantages can be provided by using an ultrasonic devices 27 that includes a pair of first and second ultrasonic devices 27*a* and 27*b*. In particular, the ultrasonic waves generated by the first ultrasonic device 27*a* generally do not reach the projection 25*a* of the surface treatment chamber 25. As such, the first ultrasonic device 27*a* applies ultrasonic waves to form the bubble nuclei, while the second ultrasonic device 27*b* applies ultrasonic waves to expand the air bubbles, preferably continuously, so that they collapse.

Figure 7:
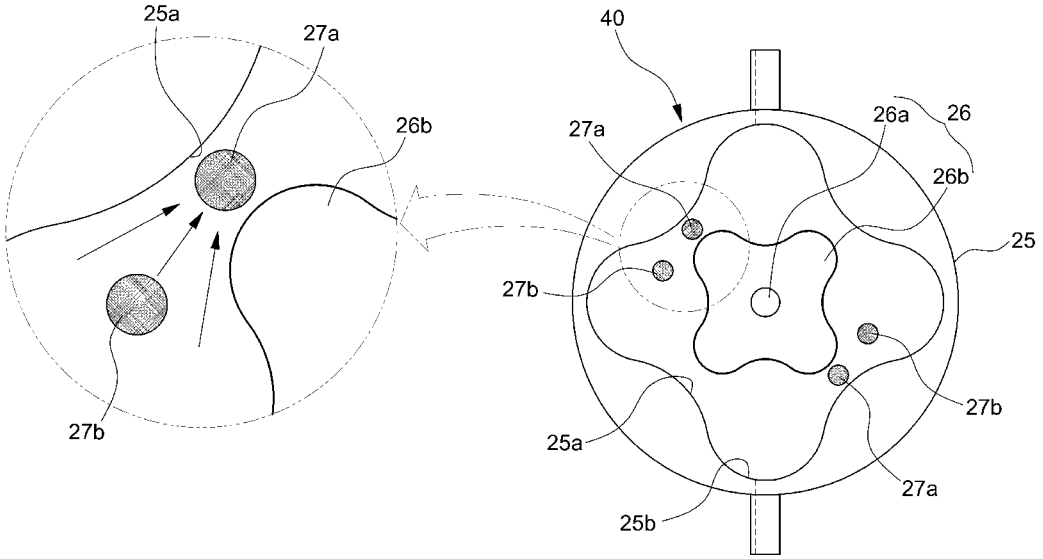
FIG. 7 is a plan view showing an ultrasonic surface treatment apparatus of FIG. 3.

In an exemplary embodiment shown in FIG. 7, the first ultrasonic device 27*a* is disposed before the projection 25*a* of the surface treatment chamber 25 to apply ultrasonic waves to the mixture of waste foundry sand and water before the mixture is rotated by the grinding rod 26 to reach the projection 25*a* of the surface treatment chamber 25. The bubble nuclei are thus formed on the critical surface(s) between the waste foundry sand 10 and the binder 13 and in the gap(s) of the binder 13, as shown in FIG. 9. As further shown in FIG. 7, the second ultrasonic device 27*b* applies ultrasonic waves to the mixture that reaches the projection 25*a* of the surface treatment chamber 25, to thus cause the air bubbles on the critical surface(s) and in the gap(s) to grow. As the air bubbles grow to their maximum size, they collapse, and the impact energy produced during collapse causes separation between the waste foundry sand 10 and the binder 13 and one or more cracks in the binder 13, as shown in FIG. 9.

As shown in the schematic of FIG. 3, the mixture of waste foundry sand and water is discharged from the surface treatment chamber 25, for example through an outlet 30 at the bottom (or elsewhere) of the chamber 25. The mixture of waste foundry sand and water can then be transferred to a dehumidifying dryer 31 by the vacuum pump 22, as shown in FIG. 3.

In a preferred embodiment as shown in FIG. 3, the dehumidifying dryer 31 includes a dehumidifying chamber 32 having a plurality of discharge holes to dehumidify the mixture of waste foundry sand and water stored in the dehumidifying chamber 32. For example, the mixture can be dehumidified through the discharge holes by rotating the dehumidifying chamber 32 using a motor (not shown) or the like.

In a preferred embodiment, the dehumidifying dryer 31 includes an air blower 34 equipped with an electric heater 33 to supply air heated by the electric heater 33 to the wet waste foundry sand 10 stored in the dehumidifying chamber 32, thereby drying the waste foundry sand 10. As shown in the schematic of FIG. 3, the air blower 34 equipped with the electric heater 33 can be provided at the bottom of the dehumidifying chamber 32.

The dehumidifying dryer 31 includes an outlet for discharging dried foundry sand 10 therefrom. In an exemplary embodiment, an outlet that can be opened and closed is provided at the bottom of the drier 31, such that the waste foundry sand 10 can be retained within the drier 31 until it is dried, and thereafter the dried waste foundry sand 10 can be discharged through the outlet.

In a preferred embodiment, the waste foundry sand 10 discharged from the dehumidifying dryer 31 is transferred to a centrifugal dust collector 35 via an inlet, preferable with the aid of vacuum pump 22 or the like if desired. The centrifugal dust collector 35 includes a bag filter 36 to collect the binders 13 separated from the waste foundry sand 10 due to a difference in specific gravity between the waste foundry sand 10 and the binder 13. In an exemplary embodiment, a bag filter 36 is provided at the top of the centrifugal dust collector 35 for collecting binders 13, while further blowing the dehumidified waste foundry sand 34 with an air blower 34. The waste foundry sand 10, from which the binders 13 have been removed by the bag filter 36, falls down to the bottom of the centrifugal dust collector 35 where it is then fed to an a binder grinding apparatus 37 via an inlet, with the aid of a vacuum pump 22 or the like if desired.

Figure 6:
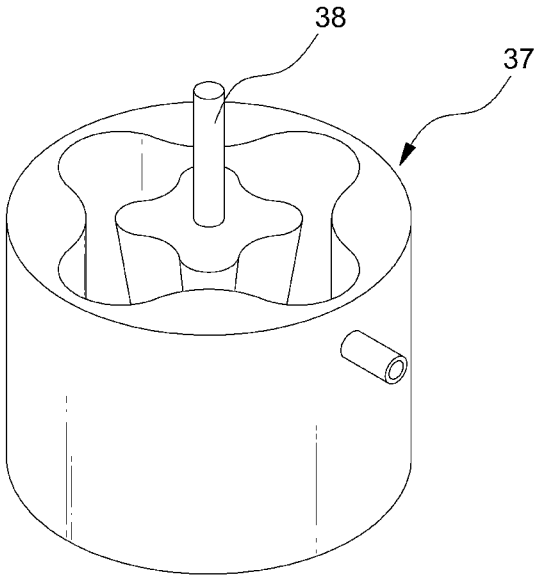
FIG. 6 is a perspective view showing a binder grinding apparatus of FIG. 3.

As shown in FIG. 6, in a preferred embodiment the binder grinding apparatus 37 has the same or similar shape as the above-described ultrasonic surface treatment apparatus 40. However, the binder grinding apparatus 37 does not have an ultrasonic device 27 is installed therein. The binder grinding apparatus 37 rotates the waste foundry sand 10 by means of a grinding rod 38 until the desired or standard foundry sand grain size it obtained (e.g., 20 to 70 mesh) to produce recycled foundry sand. The recycled foundry sand having the desired or standard grain size is then transferred to a sieving device 39, with the assistance of a vacuum pump 22 or the like if desired.

The sieving device 39 sieves the recycled foundry sands having the desired or standard grain size that are to be reused as flux for copper smelting, subsidiary material for brick production, material for embankment, subsidiary material for cement production, etc.

Figure 8:
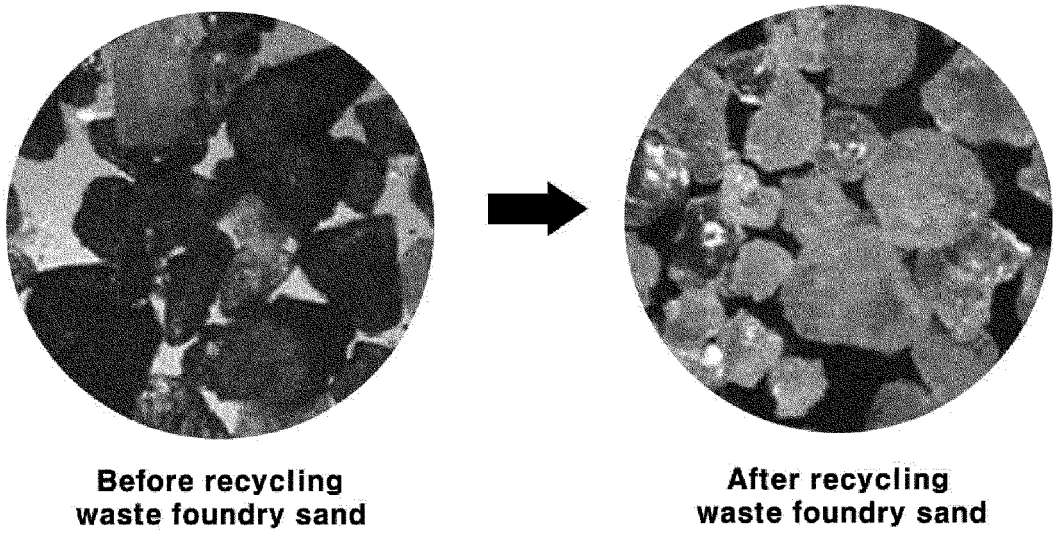
FIG. 8 shows photographs of waste foundry sand before and after recycling.

The photographs in FIG. 8 show a waste foundry sand before and after recycling, wherein separation system for the waste foundry sand binder according to the present invention is used. As shown, the present methods provide recycled foundry sand from which the binder material has been removed.

In accordance with the present methods, ultrasonic surface treatment is used to remove binders from a waste foundry sand by the formation of bubble nuclei, which grow and collapse to thereby separate the foundry sand from the binder and, further, to form one or more cracks in the binder. The operation of the ultrasonic surface treatment apparatus 40 to remove the binders 13 from the waste foundry sand 10 using ultrasonic waves will be described in more detail in connection with FIG. 9, which illustrates the formation, growth, and collapse of bubble nuclei by ultrasonic waves in the ultrasonic surface treatment apparatus of the present invention.

As shown in FIG. 9, the carbonizing binder 11 and the fixing binder 12, which are bonded to the surface of the foundry sand 10, are carbonized with thermosetting resin by a high temperature process which is carried out during casting at about 600° C. or higher, and gaps are formed in the binder during carbonization of polymers of the binder 13.

In accordance with the present invention, a solution (preferably water) is supplied to the inside of the ultrasonic surface treatment apparatus 40 (e.g. through the water pipe 29 or the like) and the grinding rod 26 is rotated as the waste foundry sand 10 is fed into the ultrasonic surface treatment apparatus 40. The waste foundry sand 10 and the solution are mixed together and, at the same time, the mixture of the waste foundry sand and the solution is rotated in the surface treatment chamber 25 by the grinding rod 26.

As the waste foundry sand 10 and the solution are mixed, the solution penetrates the gaps in the binder 13 and reaches the critical surface between the foundry sand 10 and the binder 13. As a result, the critical surface between the foundry sand 10 and the binder 13 and the gaps in the binder 13 are wetted by the solution.

Thereafter, when ultrasonic waves, preferably of 3.5 $kW/m^2$ or higher, are applied to the mixture, the ultrasonic waves pass through the solution and generate an acoustic pressure such that cavitation occurs. In other words, the bubble nuclei are formed on the critical surface between the waste foundry sand 10 and the binder 13 and in the gap(s) of the binder 13. Subsequently, when the bubble nuclei grow and reach the critical point (their maximum size), the air bubbles collapse.

As this occurs, a high temperature of about 4,700° C. and a high pressure gas of about 1,000 atm are instantly generated, and oxidized materials having a polarity (such as OH radical) are produced.

As a result, impact energy is produced, and the separation of the critical surface and the cracks in the binder 13 are induced by the impact energy.

Thus, when the ultrasonic waves are applied to the waste foundry sand 10, the separation of the binder 13 is partially caused by the impact energy. Further, when ultrasonic waves, preferably of 16 kHz or higher, are applied to the mixture using the first ultrasonic device 27*a* before the mixture reaches the projection 25*a*, the bubble nuclei are formed on the critical surface between the waste foundry sand 10 and the binder 13 and in the gap of the binder 13, and grow gradually. Subsequently, the air bubbles grow to their maximum size (or critical point) by application of ultrasonic waves by the second ultrasonic device 27*b*, and thereby collapse.

Further, the density between the waste foundry sands 10 is increased in a region where the distance between the projection of the grinding rod 26 and the projection 25*a* of the surface treatment chamber 25 is minimal, and thus the frictional force between the waste foundry sands is increased. As a result, separation between the waste foundry sand 10 and the binder 13 and the crack(s) in the binder 13 is induced in this region by the increase in frictional force and by the collapse of air bubbles.

Further, a rotational friction force between the waste foundry sands 10 and between the waste foundry sand 10 and the grinding rod 26 is generated by the rotational force of the grinding rod 26. Thus, the binder 13 that cracks in the region where the distance between the projection of the grinding rod 26 and the projection 25*a* of the surface treatment chamber 25 is minimal, is separated by the rotational friction force.

In preferred embodiments, wherein the grinding rod 26 has a conical shape in which the area is increased from the bottom toward the top, waste foundry sand 10 can be prevented from rising due to the increase in frictional force between the waste foundry sands 10 and the increase in density. The increase in the frictional force between the waste foundry sands 10 further promotes the separation between the waste foundry sand 10 and the binder 13 and the formation of one or more cracks in the binder 13.

As described above, the separation system for the waste foundry sand binder using ultrasonic waves according to the present invention has the following advantages.

1. It is possible to minimize the number of surface treatment processes by inducing interface separation between the foundry sand and the binder, in contrast with conventional expensive heat treatment and surface treatment processes. As such, the present systems and methods optimize the working process and reduce the recycling cost of waste foundry sand by integrating multi-step processes; and 2. With the use of the grinding rod having a conical shape in which the area is increased as it goes toward the top, it is possible to prevent the waste foundry sand from rising due to the increase in frictional force between the waste foundry sands and the increase in density, so as to further increase the frictional force between the waste foundry sands, thereby promoting the separation between the waste foundry sand and the binder and the formation of one or more cracks in the binder.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A separation system for a waste foundry sand binder using ultrasonic waves, the system comprising:

an ultrasonic surface treatment apparatus, which comprises a grinding rod rotatably mounted therein to mix waste foundry sand and water and an ultrasonic device mounted therein to apply ultrasonic waves to the mixture of waste foundry sand and water so as to generate air bubbles on the critical surface between the waste foundry sand and a binder and in one or more gaps of the binder, thereby causing separation of the binder from the waste foundry sand and one or more cracks in the binder by impact energy generated when the air bubbles collapse;

a dehumidifying dryer, which dehumidifies the mixture of waste foundry sand and water discharged from the ultrasonic surface treatment apparatus and dries the waste foundry sand by supplying air heated by an electric heater mounted in an air blower to the waste foundry sand using the air blower; and a binder grinding apparatus, which comprises a grinding rod rotatably mounted therein to remove the binder remaining on the dried waste foundry sand by grinding.

2. The system of claim 1, wherein the ultrasonic surface treatment apparatus comprises:

a surface treatment chamber comprising one or more projections and recesses formed alternately on the inner circumferential surface of the surface treatment chamber;

a grinding rod mounted inside the surface treatment chamber to rotate the mixture of waste foundry sand and water stored in the surface treatment chamber; and a plurality of ultrasonic devices mounted inside the surface treatment chamber to apply ultrasonic waves to the mixture of waste foundry sand and water.

3. The system of claim 2, wherein the ultrasonic devices comprises:

a first ultrasonic device which generates ultrasonic waves in a position before a projection of the surface treatment chamber to form bubble nuclei on the critical surface between the waste foundry sand and the binder and in one or more gaps of the binder; and a second ultrasonic device which generates ultrasonic waves in a position adjacent to the projection of the surface treatment chamber to allow the bubble nuclei to grow and collapse.

4. The system of claim 1, wherein the grinding rod comprises one or more projections and recesses which extend in the longitudinal direction and are disposed alternately in the circumferential direction.

5. The system of claim 1, wherein the grinding rod has a tapered shape in which the diameter decreases from the top to the bottom.

6. The system of claim 1, further comprising a hopper and a crusher, wherein a waste casting mold is fed into the hopper and crushed into the waste foundry sand by the crusher, and wherein the waste foundry sand is supplied from the crusher to the ultrasonic surface treatment apparatus.

7. The system of claim 1, further comprising a vibrating sieve which sieves the waste foundry sands with a standard grain size by vibration before the waste foundry sand is supplied to the ultrasonic surface treatment apparatus.

8. The system of claim 1, further comprising a centrifugal dust collector which includes a bag filter at the top to collect the binders separated from the waste foundry sand due to a difference in specific gravity between the waste foundry sand and the binder.

9. The system of claim 1, further comprising a sieving device which sieves the recycled foundry sands discharged from the binder grinding apparatus.

10. The system of claim 1, wherein the binder grinding apparatus comprises:

a surface treatment chamber including one or more projections and recesses formed on the inner circumferential surface; and a grinding rod rotatably mounted inside the surface treatment chamber to rotate the waste foundry sand stored in the surface treatment chamber.

11. The system of claim 2, wherein the grinding rod comprises one or more projections and recesses which extend in the longitudinal direction and are disposed alternately in the circumferential direction.

12. The system of claim 2, wherein the grinding rod has a tapered shape in which the diameter decreases from the top to the bottom.

* * * * *